United States Patent [19]

Nathan

[11] Patent Number: 4,467,927

[45] Date of Patent: Aug. 28, 1984

[54] MOLDED TRAY FOR DISPLAY STANDS

[76] Inventor: Walter Nathan, 1053 Skokie Ridge Dr., Glencoe, Ill. 60022

[21] Appl. No.: 407,460

[22] Filed: Aug. 12, 1982

[51] Int. Cl.[3] ..... A47F 5/16

[52] U.S. Cl. ..... 211/153; 108/91; 108/111; 211/186; 211/188

[58] Field of Search ..... 211/187, 186, 153, 188, 211/194, 126, 134, 135; 108/91, 111, 53.5, 53.1

[56] References Cited

U.S. PATENT DOCUMENTS

| | | | |
|---|---|---|---|
| 3,749,343 | 7/1973 | Marschak | 211/134 X |
| 3,777,673 | 12/1973 | Blazey et al. | 108/111 X |
| 3,834,324 | 9/1974 | Long | 211/126 X |
| 3,927,769 | 12/1975 | Maslow | 211/153 |
| 4,099,472 | 7/1978 | Kellogg | 211/188 X |
| 4,428,487 | 1/1984 | Hepp | 108/91 X |

FOREIGN PATENT DOCUMENTS

| | | | |
|---|---|---|---|
| 759799 | 5/1967 | Canada | 211/126 |
| 3006377 | 8/1981 | Fed. Rep. of Germany | 211/153 |

*Primary Examiner*—William H. Schultz
*Assistant Examiner*—Robert W. Gibson, Jr.
*Attorney, Agent, or Firm*—Norman Lettvin

[57] ABSTRACT

An improved molded tray for a display stand is shaped to provide a rectangular planar product-support member, whose support area is free of structural invasion by other parts of the tray. The planar product-support member is reinforced by an integral, transverse, peripheral reinforcing flange that extends vertically along the periphery of the support member. Integral, tubular corner post-receiving means are provided adjacent each corner of the support member and tangent to the peripheral flange. Reinforcing strips extend parallel to and outwardly of the reinforcing flange at two opposed sides of the tray, and are integral with the tubular post-receiving means. A horizontal top wall joins the upper edges of the peripheral flange and each parallel reinforcing strip. The underside of the planar support member is reinforced by a grid of orthogonal ribs, and the support member is apertured, between the reinforcing ribs to reduce the amount of plastic used in forming the tray. The corner post-receiving means provides an upper, reduced height, stud concentric with a sleeve for cooperation with a tubular post, and a lower, extended length stud, concentric with a short sleeve for cooperation with a tubular post. The lower extended stud length provides versatile usage.

12 Claims, 7 Drawing Figures

FIG. 3
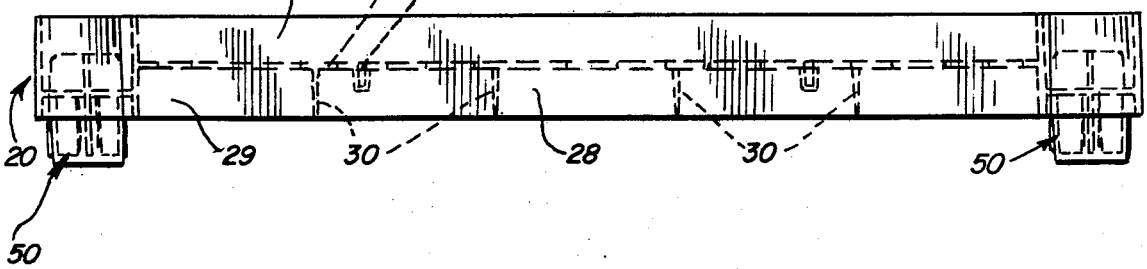
FIG. 4
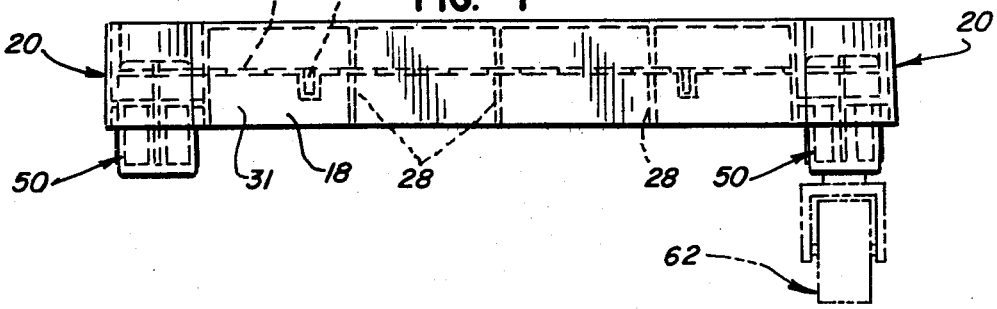
FIG. 5
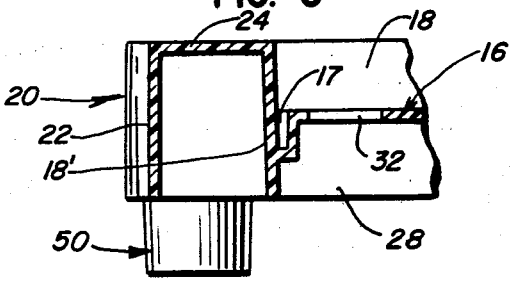
FIG. 7
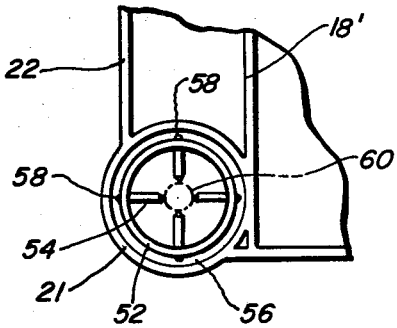
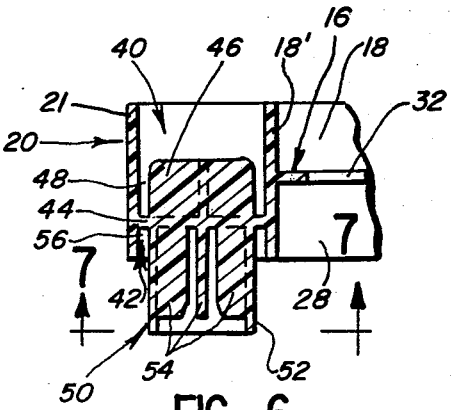
FIG. 6

MOLDED TRAY FOR DISPLAY STANDS

FIELD OF THE INVENTION

This invention relates to an improved shelf for a knock-down display stand that is formed from a plurality of molded plastic shelves that are spaced apart vertically by lightweight tubular posts which, together with sleeve parts, formed integrally on the plastic shelves, provide the vertical structural uprights for the display stand.

BACKGROUND OF THE INVENTION

It is known to provide, for use in a knock-down stand for displaying wares, a plurality of molded plastic shelves, with integral sleeves thereon that are designed to be adapted to telescopically cooperate with light weight tubular posts which, when assembled with the shelves, provides the vertical structural upright supports for the display stand.

Such prior art display stands, and the shelves therefor, have included guasi-rectangular, generally planar, plastic, shelf members, each formed integral with transversely extending tubular elements that provide sleeve-like members at the corners of the shelf which, because of the structural and design requirements of said previous constructions, invade and thereby diminish the intended rectangular support surface of the support member. Said prior art shelves were also formed integrally with a transverse planar flange that extended transversely along, and integral with, the exposed horizontal edges of the support member, and merged with the sleeve-like members in vertical traces that were located substantially radially of the center of the sleeve-like members. Because of the geometry of such prior shelves as described, the entire support area of the shelf could not be utilized, as a quadrant of each sleeve-like member occupied a corner of the shelf. Furthermore, said prior art plastic shelf constructions required substantial reinforcement on the underside of the support surface to withstand the product-load forces applied thereon, and to withstand the stresses developed therein.

The prior art plastic shelf constructions have had drawbacks in that the invasion of the rectangular, planar, product-support area by said tubular elements of the shelf substantially reduced the effective pay load of the shelf. Furthermore, the product support area of the shelf employed expensive plastic in an inefficient manner, thus failing to provide maximum cost effectiveness of construction.

BRIEF SUMMARY OF THE INVENTION

One object of the present invention is to provide an improved plastic shelf for a knock-down display stand, which shelf is characterized by economy of use of the plastic material to form same, and which provides a shelf having a full rectangular support surface, improved resistance to torsional stresses, employing channel-type framing elements therefor, and providing improved cost effectiveness of construction.

Another object of this invention is to provide, in a plastic shelf for a knock-down display stand, a maximum, rectangular, support shelf region thereon, and with transverse sleeve-like members of the shelf located wholly outwardly of said rectangular support shelf region so that the shelf is characterized by providing a maximum, usable, load-carrying support area for the shelf, and maximum effectivess of strength-to-material used in the shelf design.

A further object of this invention is to provide a shelf construction that, through features included in its design, has increased versatility of usage.

Further objects and advantages of this invention will become apparent to one skilled in the art from the following description of the invention.

DESCRIPTION OF THE DRAWINGS

FIG. 3 is a side elevational view of the improved shelf shown in FIG. 2;

FIG. 4 is an end elevational view of the improved shelf of FIGS. 2 and 3;

FIG. 5 is an enlarged, fragmentary, cross-sectional view taken substantially on line 5—5 of FIG. 2, and showing features of the reinforcing, channel-type framing element construction that is provided along the short edges of the improved shelf;

FIG. 6 is an enlarged, fragmentary, cross-sectional view of the corner sleeve construction of the improved shelf, and is taken substantially along line 6—6 of FIG. 2; and FIG. 7 is a fragmentary bottom plan view, taken substantially at the position shown as line 7—7 of FIG. 6, and showing details of the corner sleeve construction for the improved shelf of FIGS. 2–5.

DETAILED DESCRIPTION OF THE DRAWINGS

Figure 1:
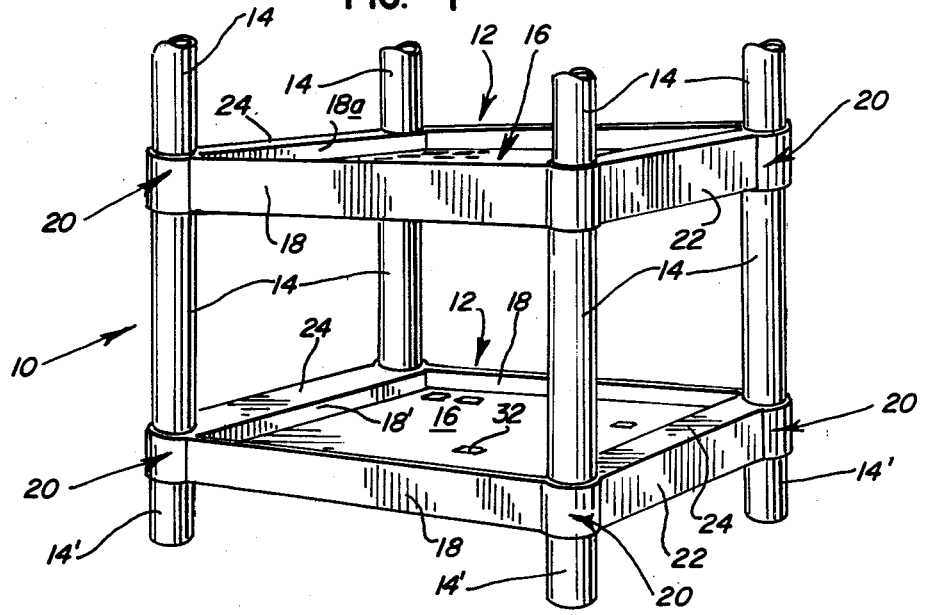
FIG. 1 is a fragmentary, reduced size, perspective view of a display stand that utilizes therein the improved shelves that are constructed in accord with the invention disclosed herein.

Referring now to the drawings, the Figures illustrate a knock-down display stand, generally 10, which comprises a plurality of shelves, each generally 12, molded as a unit of plastic and spaced vertically by tubular cardboard spacers, or post segments, 14. While the stand, illustrated in fragment is FIG. 1, is shown with only two shelves 12, it will be understood that multiple shelves may be employed, to provide a stand of any usable or desired height. The length of the tubular spacers, or post segments, 14 is selected so that goods stored upon any shelf 12 of the stand may easily be removed from the display stand by a shopper. If desirable, short spacers 14' may be provided below the lowermost shelf 12, to serve as feet for the display stand 10.

Figure 2:
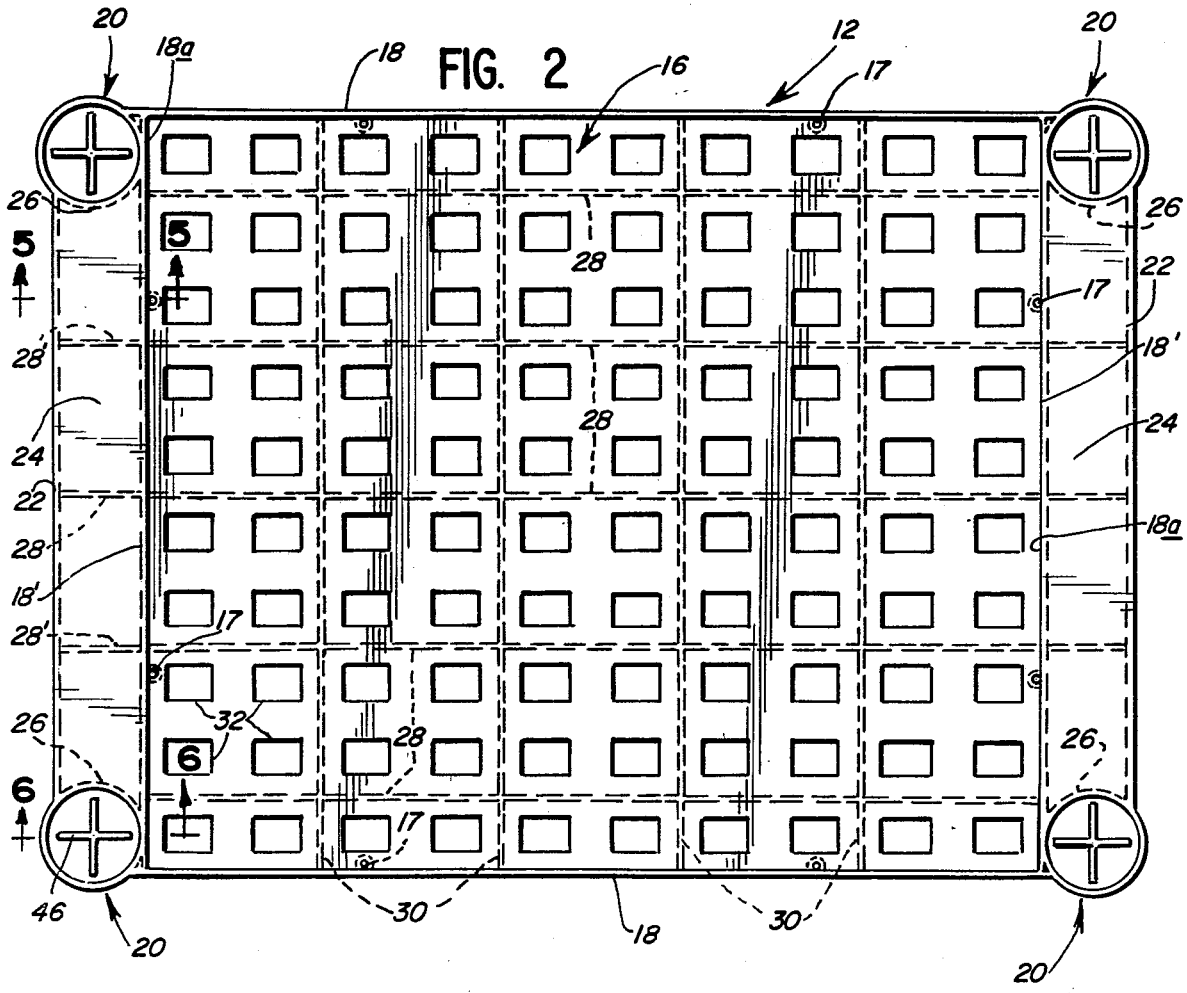
FIG. 2 is an enlarged, top plan view of the improved shelf used in a construction of the general type shown in FIG. 1.

The improved shelf 12, as best seen in detail in FIGS. 2–7, is a single, unitary, molded part, or product, that provides, as part thereof, rectangular, horizontal, product-support surface, or member, 16, as best seen in plan in FIG. 2. Surrounding the entire edgewise periphery of the rectangular area of support member 16 is a continuous, peripheral, transverse flange means 18 formed integrally, with support member 16. As best seen in FIGS. 5 and 6, the flange means 18 lies in a vertical plane transverse to horizontal support member 16 and projects both above and below the plane of horizontal support member 16. The portion of flange means 18 that projects above support member 16 serves, in part, as a side wall retainer, or rail, to confine and retain the goods supported on horizontal member 16. The entire flange means 18, located both above and below horizontal member 16, serves as a peripheral reinforcement of shelf member 16, providing reinforcement, or resistance, against bending or twisting of support member 16 and of the entire shelf 12.

The shelf 12 is also provided with a tubular, corner post-receiving, means 20 adjacent each corner of the rectangular goods supporting member 16. These post-receiving means 20 are formed integrally with the support member 16 and with the flange means 18. As best seen in FIGS 3–6, each of the post-receiving means 20 is vertically elongated and projects transversely of the plane of the goods-supporting member 16, extending both above and below the plane of member 16. The positioning and location of the post-receiving means 20 relative to flange means 18 is such that a portion of the outer periphery of each post-receiving means 20 is tangent to the outer vertical surface of flange means 18, so that each post-receiving means 20 is located wholly outwardly of the inner surface 18*a* of flange means 18.

Preferably, the post-receiving means 20 are, as seen in FIG. 2, located wholly outwardly of and adjacent the short sides, or ends, 18', of the rectangular flange means 18, with a portion of the cylindrical wall of post-receiving means 20 being tangent to, and merging with, a segment of end portion 18' of flange means 18.

An elongated reinforcing strip 22 is provided parallel to, and spaced outwardly of, each end 18' of flange means 18. Each reinforcing strip 22 is generally parallel to the end portion 18' and has its longitudinal ends terminating at the circular periphery of post-receiving means 20, at a distance horizontally spaced from end portion 18' that is greater than the radius of, but less than the diameter of, the tubular, post-receiving means 20. The vertical height of each reinforcing strip 22 corresponds substantially to the vertical height of flange means 18, so that the parallel flanges, or strips, 18' and 22 project substantially equal distances above and below the horizontal plane in which goods-supporting member 16 is located.

The upper edges of parallel flanges or strips 18' and 22 merge into, and are integral with, a horizontal, or top, elongated, transverse wall 24 that is of such a length that the ends of wall 24 merge into and are integral with the curved walls of a pair of tubular corner-post receiving means 20 along junction traces 26. The combination of walls 18', 22, and 24 provides a pair of downwardly opening channel-shaped sections at two opposite ends of the rectangular shelf 12, which together with the pair of tubular means 20 at the ends of each channel shaped section, provides substantial peripheral structural strength for shelf 12.

The product-support member 16 is unobstructed on its upper, or support, surface, and is rectangular in shape, without invasion thereof from other structural portions of shelf 12. The underside of member 16 is further reinforced by two sets of spaced reinforcing ribs 28 and 30, arranged to intersect and provide a grid of orthogonal ribs which, at their ends, merge with pairs of parallel sides of the portion of flange 18 that is below support member 16. One set of reinforcing ribs 28 terminate at the short sides 18' of the flange 18, and the other set of reinforcing ribs 30 terminate at the long sides of flange 18. The ribs 28 and 30 are of substantially uniform height along their length, And may be of the same, or lesser, vertical height as the vertical extent of flange 18 that projects below support member 16. The underside of the channel shaped sections, provided in part by spaced walls 18' and 22, may be reinforced by ribs 28' that serve, in part and in effect, as extensions of ribs 28.

With the grid of orthogonal ribs 28 and 30 reinforcing the product-support member 16, said member 16 is provided with a plurality of apertures 32 therethrough to substantially reduce the total amount of plastic used in producing a shelf unit 12. This construction also avoids undesirable molding defects, such as ripple, in the surface of member 16, and provides an attractive design appearance. The apertures 32 may be of any selected outline, square, circular, or other geometrical form as desired. Preferably the apertures 32 are rectangular, as shown, and are arranged in a pattern that locates a plurality of apertures 32 spaced equally, and geometrically, from the vertical planes of the orthogonal reinforcing ribs 28 and 30.

As an additional, optional, feature, the support member 16 may be provided with a pair of wire-receiving apertures 17 adjacent each edge of support member as seen in FIGS. 2 and 5, for receiving therein the ends of a wire-type frame that may serve as a mount for a sign or the like.

Each corner post-receiving means 20 may be provided with post-receiving means, such as of the specific construction shown in detail in FIGS. 2, 6 and 7. Each post-receiving means 20 includes a generally cylindrical sleeve 21 that is vertically oriented. The means 20 is formed to provide an upper cavity 40 and a lower cavity 42, both of generally cylindrical periphery defined by the innner surface of sleeve 21, which sections are separated by a transverse wall 44 that is common to both said upper and lower cavities with wall 44 located axially between the ends of sleeve 21 and closer to the lower terminus of sleeve 21 than to the upper terminus of sleeve 21. Each upper cavity 40 has formed therein an upper stud 46, of star, or cross-shaped, cross-section as seen in FIG. 2, and of lesser vertical axial extent than the surrounding portion of sleeve 21. The maximum circumferential dimension of stud 46, defined by the stud's outer edges, is spaced concentrically inwardly of the inner wall of sleeve 21 to provide an annual groove, or recess, 48 adapted to receive, and grip therein, an end of a tubular cardboard post 14. Thus, when a post 14 enters the upper sleeve section 40, it is guided by the inner surface of sleeve 21, until its terminus enters into annular recess 48, where post 14 surrounds and engages stud 46 to be stabilized thereby, while the outer surface of post 14 also engages the inner wall of sleeve 21 to be stabilized thereby.

The lower cavity 42 has therein a lower stud 50 concentric with sleeve 21, and with an axial length greater than the axial length of the portion of sleeve 21 that bounds lower cavity 42, so that stud 50 projects below the lower terminus of sleeve 21. The lower stud 50 is in the shape of an axially elongated tube 52 that is internally reinforced by a plurality of axially elongated ribs 54 that project from the inner wall of tube 52 radially inwardly, but do not engage each other, as seen in FIG. 7.

The concentric outer sleeve 21 and inner lower stud 50 provide therebetween an annular recess 56 of a size to receive thereinto, in a snug fit, an upper end of a cardboard post 14. The size of tube 52 is selected to provide a snug and rigidifying fit with the interior of a tubular cardboard post 14. If desired, the tubular exterior of stud tube 52 may be provided with enlargements, or axial ridges, 58 which provide for a tighter press-fit connection with the partially compressible wall of a tubular cardboard post 14.

The corner post construction 20, and the details of its upper section and lower sections, provides for increased versatility of use of the improved shelf member 12. Thus, the portions of each stud 50 that project below the lower terminus of the surrounding sleeve 21 will serve as a support leg upon which the shelf is supported when the shelf is rested directly on the ground or on a floor, and serves to keep the lower edges of the sleeves 21 and of flange means 18 and of walls 22 spaced above the supporting surface and to substantially avoid wear or damage to those elements of the shelf.

Additionally, the axial length of that portion of stud 50, which projects below the lower edge of its surrounding sleeve 21 is selected to be greater than the axial spacing of the upper surface of stud 46 below the plane of the upper edge of sleeve 21. This relationship permits pairs of shelf members 12 to be stacked with the lower studs 50 of one shelf telescoped into the upper sleeves 21 of a second shelf, for purposes of space saving when effecting shipment to users, and without the upper and lower edges of the sleeves 21 and of the flange means 18 touching, thereby protecting against scuffing, abrasion, or damage of those parts which are visible in an assembled stand. A thin, circular, cardboard spacer may be introduced on top of each member 46 for purposes of preventing damage thereto when multiple shelf members 12 are stacked on each other for purposes of storage or shipment.

Also, the radial inner edges of the axially extending ribs 54 within tube 52 are designed to be located on the periphery of a circle that is of a size to releasably receive and grip, through a slip, or slight-press, fit the mounting stem, 60, of a caster 62 which is illustrated, as an alternative usage, by broken lines in FIG. 4. The use of casters at the four corners of a shelf, when the shelf is in its condition as shown in FIGS. 3 and 4 as separate from a stand, will convert the shelf into a dolly.

While I have disclosed herein an improved molded tray for a display stand, persons skilled in that art will appreciate that the invention herein may be adapted and modified for related purposes, and it is intended to cover all aspects of my invention herein, as limited solely in the claims appended hereto.

What is claimed and desired to be secured by Letters Patent of the United States is:

1. A molded, plastic, unitary shelf member that is adapted for use as part of a display stand that is formed by a plurality of said shelf members that are vertically spaced apart by a plurality of tubular posts, comprising, in combination:

a rectangular, planar, horizontal, product-support member whose upper support surface is free of structural invasions into the support area thereof, so as to maximize the product-carrying capacity of said upper support surface;

a continuous, peripheral, transverse, reinforcing, flange means of rectangular configuration in plan, formed integrally along the entire exterior edgewise periphery of said rectangular support member and projecting both above and below the plane of said horizontal support member, to provide both a rectangular, peripheral, side wall retainer for retaining goods carried on the upper surface of said support member and also to serve as peripheral shelf reinforcement against bending or twisting of the shelf member;

tubular, corner post-receiving, means formed integrally with said planar support member and with said peripheral flange means, and projecting transversely both above and below the plane of said planar support member, and located wholly outwardly of the inner, rectangular, surface of said reinforcing flange means;

and a pair of elongated reinforcing strips lying in planes transverse to the plane of the horizontal support member, said reinforcing strips extending parallel to, and being located spaced outwardly of, one opposed pair of spaced, parallel sides of said rectangular flange means, with the longitudinal ends of each said elongated reinforcing strip being formed integrally with one pair of said corner post receiving means, for rigidifying said tubular corner post-receiving means relative to each other, and also for rigidifying the rectangular, horizontal, support member and its peripheral, transverse, reinforcing flange means.

2. A construction as in claim 1 wherein said tubular, corner post-receiving means lie substantially tangent to the outer surface of said peripheral flange means, and said pair of reinforcing strips are each spaced from a pair of parallel sides of the rectangular flange a distance greater than the radius of, but less than the diameter of, the tubular, corner post-receiving means.

3. A construction as in claim 2 wherein the flange means and reinforcing strips project substantially equal distances both above and below the plane of the rectangular support member.

4. A construction as in claim 1 wherein the underside of the rectangular support member is reinforced by a rectangular grid of orthogonal ribs integral with the under surface of said support member, and integral at their ends with the portion of the peripheral flange means that projects below the plane of said support member.

5. A construction as in claim 1 or claim 4 wherein the rectangular support member is provided, in the regions thereof that are free of reinforcement, with a pattern of apertures therethrough, that operates to reduce the total amount of plastic employed in forming the shelf member.

6. A construction as in claim 1 wherein each tubular, corner post-receiving means is formed to provide an upper sleeve section and a lower sleeve section separated by an integral transverse wall; each said transverse wall being located axially between the ends of said tubular means to define therewith an upper, post-receiving, cavity and a lower, post-receiving, cavity; said upper cavity being of greater axial depth than that of the lower cavity; each said upper, post-receiving cavity having formed therein an upper stud of lesser axial extent than the axial depth of the upper cavity, and with an outermost radial extent spaced concentrically inwardly from the inner wall of the upper sleeve section to provide a annular recess adapted for receiving thereinto an end of a tubular post; and each said lower, post-receiving, cavity having formed therein a lower stud concentric with the lower sleeve section and spaced therefrom, and of greater axial extent than the axial extent of said lower cavity, whereby said lower stud projects axially outwardly beyond the axial extent of the surrounding lower sleeve section that bounds said lower cavity.

7. A construction as in claim 6 wherein the exterior cross section of the upper stud is cross-shaped, and the exterior cross-section of the lower stud is substantially cylindrical.

8. A construction as in claim 6 wherein said lower stud includes a part of tubular cross-section that is internally reinforced by a plurality of radially extending ribs.

9. A construction as in claim 1 wherein each reinforcing strip and its adjacent parallel side of the rectangular flange means are integrally joined together by a top transverse wall that is integral with the upper edges of both said reinforcing strip and its adjacent parallel side of the rectangular flange means, and with the longitudinal ends of each said top transverse wall merging into and being integral with the adjacent curved wall of a tubular corner post-receiving means, to provide a rigidified structural junction thereat.

10. A construction as in claim 9 including a plurality of transversely extending, elongated, ribs integral with the underside of said top transverse wall, and whose ends extend to and are integral with the oppositely facing surfaces of the pair of upright sides that includes one reinforcing strip and its adjacent parallel side of the rectangular flange means, for effecting further rigidification of said parts.

11. A construction as in claim 8 wherein the radially extending internal ribs of the lower stud are of a selected size to provide means adapted to releasably receive the mounting stem of a caster.

12. A construction as in claim 6 wherein the axial extent of the lower stud which projects below the lower edge of the lower sleeve section is greater than the axial spacing of the upper edge of the upper stud below the upper edge of the upper sleeve section, so that a pair of shelves may be stacked with the lower edges of the lower studs of one shelf supported on the upper edges of the upper studs of a second shelf.

* * * * *